US008179337B2

(12) United States Patent
Wilzbach et al.

(10) Patent No.: US 8,179,337 B2
(45) Date of Patent: May 15, 2012

(54) MOBILE PROJECTED SETS

(75) Inventors: Gregory A. Wilzbach, Santa Clarita, CA (US); Janice L. Mulholland, Altadena, CA (US); Thomas J. Fitzgerald, Altadena, CA (US); David A. Durham, Northridge, CA (US); David W. Crawford, Long Beach, CA (US)

(73) Assignee: Disney Enterprises, Burbank, CA (US)

( * ) Notice: Subject to any disclaimer, the term of this patent is extended or adjusted under 35 U.S.C. 154(b) by 902 days.

(21) Appl. No.: 12/202,842

(22) Filed: Sep. 2, 2008

(65) Prior Publication Data

US 2010/0053029 A1 Mar. 4, 2010

(51) Int. Cl.
*G09G 5/00* (2006.01)

(52) U.S. Cl. ..... 345/2.3; 472/43; 104/53

(58) Field of Classification Search ..... 345/2.3, 345/1.1–4, 87, 204, 31; 104/53–86; 463/31–34, 463/5; 472/27, 28, 43, 59–61, 130; 434/37
See application file for complete search history.

(56) References Cited

U.S. PATENT DOCUMENTS

| | | | | |
|---|---|---|---|---|
| 5,336,132 | A | 8/1994 | Murakami | |
| 6,179,619 | B1 | 1/2001 | Tanaka | |
| 6,347,999 | B1 * | 2/2002 | Yuan | 463/46 |
| 2002/0068640 | A1 * | 6/2002 | Uemura et al. | 472/60 |
| 2002/0068641 | A1 * | 6/2002 | Dicicco | 472/60 |
| 2008/0188318 | A1 | 8/2008 | Piccionelli et al. | |

FOREIGN PATENT DOCUMENTS

WO WO2007044708 4/2007

OTHER PUBLICATIONS

International Search Report, PCT/US09/052858, 4 pages, Nov. 5, 2009.

* cited by examiner

*Primary Examiner* — Stephen Sherman
(74) *Attorney, Agent, or Firm* — Dorsey & Whitney LLP

(57) ABSTRACT

One particular implementation of the present invention may take the form of a mobile set configured to include one or more projection devices to display a media presentation to a viewer. The mobile set may be configured to follow a fixed path or may move through autonomous navigation. In one embodiment, the mobile set may be included as part of an amusement park ride to interact with the ride patrons and provide them with a greater entertainment experience. For example, the mobile projected set may be synchronized to move with a carrier vehicle carrying the ride patrons and project a presentation or display to the ride patrons during the ride. Placing the projected scene on a mobile set allows the patrons to interact with the projected scene for a longer period of time then if the projected scene was stationary. Further, the mobile sets may be used to configure and control sightlines through the ride to provide a more dynamic environment for the amusement park ride.

21 Claims, 9 Drawing Sheets

MOBILE PROJECTED SETS

FIELD OF THE INVENTION

Aspects of the present invention relate to an amusement park attraction, and more particularly to a mobile projected set that may move and interact with the patrons of an amusement park ride attraction.

BACKGROUND

Amusement parks and vacation destinations often provide attractions and rides to entertain the patrons of the park. Amusement park rides may range from high-speed thrill rides, such as a rollercoaster, to more entertainment, story-based rides, such as a merry-go-round or a haunted house. These attractions are designed to provide the patrons with a fun and/or thrilling experience as part of the admission price to the park.

One type of an entertainment-based ride may place the ride patron or patrons in a vehicle configured to transport the patrons along a fixed path or track. Along the path, several displays or projected scenes may be provided to entertain the rider. For example, an amusement park ride may place several park patrons into a vehicle that enters a series of rooms or scenes. Each room or scene along the path of the ride may tell a part of an overall story that engages the patrons. To facilitate the telling of the story, each room may include a display or set to engage the ride patrons as their ride car passes by. For example, a puppet or animatronics display may be placed near the path of the vehicle to entertain the riders as the vehicle passes. The puppet display may talk to the patrons or perform some sort of act as the ride vehicle carrying the patrons passes, thereby progressing the overall story arc. Other types of displays may include a 2-D or 3-D projected scene, a display with live actors, or a static scene with no moving parts. The designed effect of the ride is to entertain the riders as they pass through the series of rooms, thereby providing a memorable experience for the park patrons.

SUMMARY

As discussed above, many amusement park rides include displays that are set-up along a fixed path such that a vehicle carrying riders may view the display as the their vehicle moves past the display. However, generally the displays are confined to the area in which they are set-up. Once the vehicle moves past the display, the display may no longer be visible to the riders. Therefore, the patrons of the amusement park ride are limited in the amount of time they can view a particular scene. The amount of time to view each display is further limited by the fact that there is likely another group of ride patrons following closely behind the first vehicle. Thus, what is needed, among other things, is a display that is mobile and may move with the vehicles of the ride to provide the patrons with a longer view time of each display. The mobile sets may also provide increased immersion of the patrons by providing transformable environments, including manipulating the sightlines of the patrons to prevent them from viewing the back of a set piece.

One embodiment of the present disclosure may take the form of a mobile electronic image display system. The display system may comprise an automated mobile set and a display device supported on the automated mobile platform. The display device may be in communication with a display media control configured to provide one or more electronic images for presentation on the display device.

Another embodiment of the present disclosure may take the form of a method of providing mobile electronic images. The method may comprise coordinating the movement of a mobile display set with a separate rider vehicle with the rider vehicle configured to transport at least one patron. The method may further comprise selecting the electronic images to display on the mobile display set and displaying the electronic images on a display device of the mobile display set, where the mobile display set may be configured such that the electronic images may be viewed by the at least one patron.

DETAILED DESCRIPTION

One particular implementation conforming to aspects of the present disclosure may take the form of a mobile set configured to include one or more display devices. The mobile set may be configured to follow a fixed or pre-determined path. For example, the mobile set may follow a fixed path by following a physical track or path, by storing the fixed path directly onto the mobile set in a drive control device, or by receiving a transmitted fixed path to the drive control device over a wireless network. Alternatively, the mobile set may be allowed to move through an autonomous navigation that allows the mobile set to determine the path of the vehicle in real time and may vary from ride cycle to ride cycle. The path of the mobile set in an autonomous environment may be based on inputs received from patrons of a ride or an operator or controller.

The one or more display devices of the mobile set may also display media to a viewer. The media may be stored directly on the mobile set in a media control device or may be transmitted to the mobile set through a wireless network. Further, the presented media may be altered by inputs provided to the mobile set by a viewer or a system administrator.

The mobile projected set may be included as part of an amusement park ride to interact with the ride patrons and provide them with a more immersive entertainment experience. For example, the mobile projected set may be synchronized to move with a carrier vehicle carrying the ride patrons and to project an animated scene or display to the ride patrons during the ride. Placing the projected scene on a mobile set allows the patrons to interact with the projected scene for a longer period of time than if the projected scene was stationary. Further, the mobile sets may be used to configure and control sightlines through the ride to provide a more dynamic environment for the amusement park ride. For example, several mobile sets may be positioned in a line to create a mobile wall from one section of the ride to another. In such an arrangement, the mobile sets may alter the sightlines of the patrons to provide a more immersive experience for the patrons.

Figure 1:
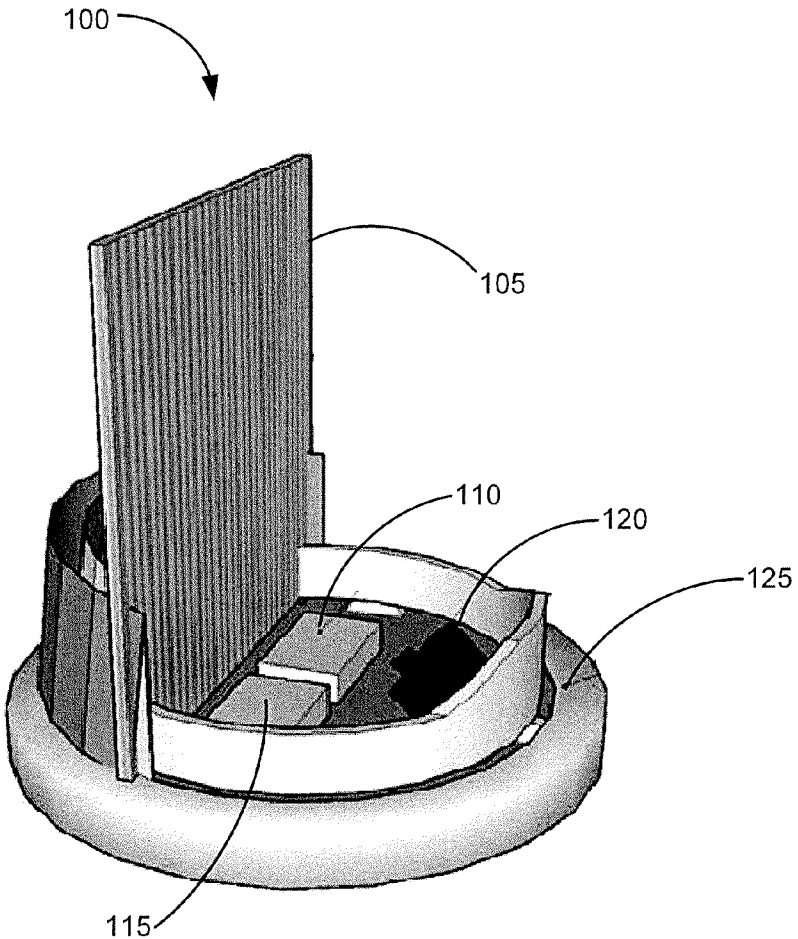
FIG. 1 is an isometric view of one embodiment of an individual mobile projected set.

FIG. 1 is an isometric view of one embodiment of an individual automated mobile projected set 100. The mobile set 100 may include several devices for facilitating the mobile nature of the projected set and a projection device for displaying media to a viewer.

As shown in FIG. 1, the projection system of the mobile set 100 may include a projection screen 105, a projector 120, and a media control box 110. The projector 120 may be located near the front of the mobile set 100 oriented in such a way as to project a media onto a screen 105 located near the rear of the mobile set. The projector 120 may be a typical projector device or may be modified to conform to the shape and size of the mobile set 100. Other embodiments of the mobile set 100 may locate the projector 105 behind the projection screen 105. The media control box 110 may be coupled to the projector and may be located anywhere on the mobile set 100. Generally, some access to the media control box 100 by an administrator should be maintained. As explained in more detail below, the projection system may include several types of display devices and media control boxes.

The projection system of the mobile set 100 may be mounted on or otherwise connected to a vehicle. The projection screen 105, for example, may be mounted on the mobile set 100 such that the screen extends perpendicular from the base 125 of the set. This upright position of the screen allows a projector 120 to project some media onto the screen 105 such that viewers located away from the mobile set 100 may view the media. Because the projection system may be mounted on the mobile set 100, the projected media displayed on the screen 105 may be dynamically positioned in front of several viewers and may also be synchronized to move with the viewers motion.

As shown above, the projection device may be mounted on an automated mobile vehicle capable of maneuvering the projection system. One example of a type of vehicle that the projection system may be mounted on is a mobile automated guided vehicle (AGV). A typical AGV may include a drive mechanism for moving the AGV and a control box 115 for guiding the AGV in response to inputs received from a sensor. The control box 115 may also guide the AGV in response to directional inputs received from a separate source. The drive mechanism may include at least one wheel, a drive shaft and an motorized engine to propel the drive shaft and wheel. One example of a typical AGV that may provide a base to mount the projection system is a Smart Cart manufactured by Jervis B. Webb Company of Farmington Hills, Mich. The drive mechanism and control box 115 of one embodiment of the mobile set are described in more detail below with respect to FIG. 2.

The drive mechanism of the mobile set 100 may be located in a base 125 of the set. Similar to the media control box 110, the drive control box 115 may also be located anywhere on the mobile set 100. As described in more detail below, the drive mechanism and drive control box 115 may also include a series of sensors to guide the mobile set 100 along a fixed path. These sensors may also be located within the base 125 of the mobile set 100, typically on the bottom of the set facing the ground. Surrounding the base 125 of the set may be a bumper 125 to protect the mobile set 100 in the event the set collides with another set, a rider car or something else in the area of the mobile set.

It should be noted that the projection system described above may also be mounted on several other types of vehicles. For example, the projection system may be mounted a boat that floats on water rather than on a land-based set. The boat may include a drive mechanism similar to the one described above that may propel the boat through the water to provide the media projected by the projection system to viewers positioned to view the media. The projection system may also be mounted on a traditional tracked ride vehicle, such as a car of a rollercoaster or a passenger vehicle configured to house the projection system.

Figure 2:
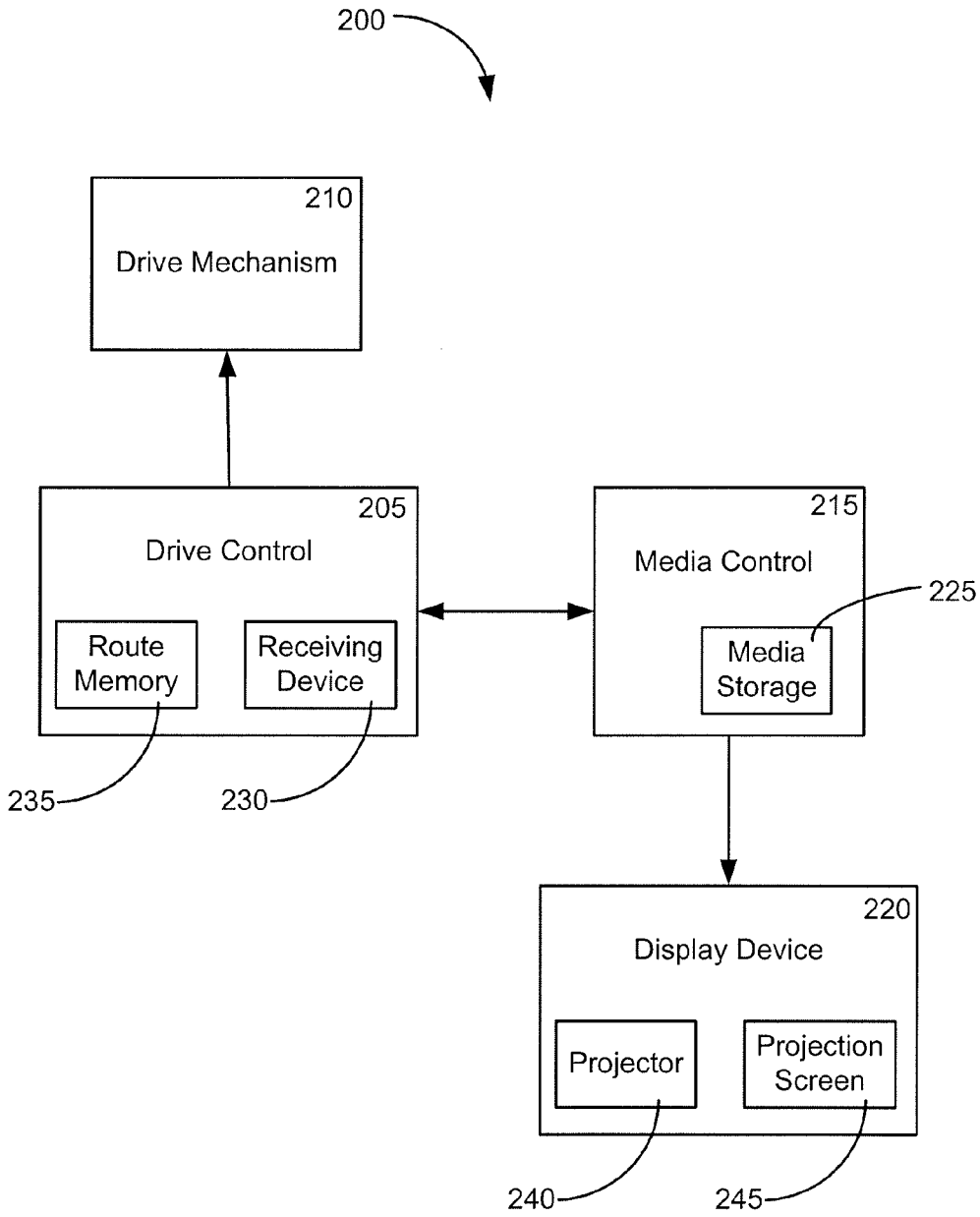
FIG. 2 is a block diagram of some of the hardware components of an embodiment of a mobile projected set.

FIG. 2 is a block diagram of some of the hardware components of an embodiment of a mobile projected set. As described above, one embodiment of the mobile set 200 may include a drive control box 205 coupled to a drive mechanism 210 to propel the mobile set. Also included may be a media control box 215 coupled to a display device 220 that may display media to a viewer as the mobile set 100 is in transit.

To provide for the mobility of the mobile set 200, a drive mechanism 210 and a drive control box 205 may be included. Generally, the drive mechanism 210 may propel the mobile set 200 and the drive control box 205 may steer the mobile set to follow a route. The drive mechanism 210 may be any system designed to propel the mobile set 200. For example, the drive mechanism 210 may include a motorized engine coupled to a drive shaft. The motorized engine may spin the drive shaft in response to an input provided by the drive control box 205 to move forward or backward. The drive shaft may be coupled to one or more wheels. The wheels may contact the ground to propel the mobile set forward or backward. In another embodiment, the engine may be a hydraulic motor. Alternatively, the drive mechanism 210 may include a pneumatic or hydraulic actuator to move the mobile set 200. It should be appreciated and understood the many different types of drive mechanisms could be integrated into and used to propel the mobile set 200.

Similarly, the mobile set 200 may be a boat and the drive mechanism 210 may be configured to propel the mobile set 200 through water. Thus, the drive mechanism may include a motorized engine coupled to a drive shaft as described above. However, the drive shaft may be coupled to a propeller device, rather than a wheel. The propeller device may then be turned by the drive shaft to propel the mobile set 200 through the water. In another example, the mobile set 200 may be guided by a water flume that the mobile set may glide through.

In communication with the drive mechanism may be a drive control box 205. The drive control box 205 may be configured to control the speed and direction of the mobile set 200 by providing control instructions to the drive mechanism 210. By providing the instructions to the drive mechanism 210, the drive control box 205 may guide the mobile set 200 to follow a fixed path or to move autonomously over an area. Several methods may be used to guide the mobile set 200. In one configuration, a sensor configured to detect radio frequencies may be placed on the bottom of the mobile set 200, facing the ground. A wire may be embedded in the ground that emits a specific radio frequency that the sensor is tuned to detect. The wire sensor may then detect the radio frequency emitting from the wire and may communicate the detected signal to a receiving device 230 located within the drive control box 205. The drive control box 205 may receive the emitted signal and provide instructions to the drive mechanism 210 to follow the path of the wire. If the mobile set 200 moves away from the embedded wire, the drive control box 205 may detect the degradation in the strength of the received signal and instruct the drive mechanism 210 to return the mobile set 200 onto the wired path. Alternatively, the wire may be replaced with a magnetic or colored tape strip that the mobile set 200 may follow in a similar manner. Similarly, the mobile set 200 may follow a track or guide bar that determines the direction of movement for the mobile set. Further, the speed of the mobile set 200 may be set by internal limitations such that power is supplied to the mobile set and the drive mechanism runs as fast as possible.

In another configuration, the receiving device 230 of the drive control box 205 may be configured to receive drive instructions remotely from a transmitting source. For example, a system administrator or technician may monitor the position of the mobile set 200 and provide instructions to the mobile set 200 over a wireless communication system. Similarly, the mobile set 200 may receive drive instructions from a computer that is configured to monitor and control the position of the mobile device 200. The computer may also monitor and control several mobile sets 200 at once and coordinate the movement of the mobile sets. In a separate embodiment, the computer may not monitor the position of the mobile set 200, but may merely provide instructions to the drive control box 205 through the receiving device 230 to have the mobile set follow a fixed path that is stored on the computer.

In yet another embodiment, the drive control box 205 may include a route memory 235 to store a fixed route that the mobile set 200 may follow. For example, a set of instructions that are provided to the drive mechanism to have the mobile set 200 follow a fixed path may be stored in the route memory 235. The drive control box 205 may access the stored instructions and provide them to the drive mechanism 210 at the appropriate times such that the mobile set 200 may follow a route. The route memory 235 may be any computer-readable storage device, including but not limited to, optical disks, flash media, floppy disks, hard drives, EEPROM memory and so on. Through the use of the route memory 235 located within the drive control box 205, the mobile set 200 may be configured to follow a fixed path without the necessity of a series of control signals being sent to the drive control box 205 by an independent source.

Similar to the embodiment described above with reference to FIG. 1, the embodiment of FIG. 2 may also include a projection system for displaying media to a viewer. The projection system may include a media control box 215 to facilitate and control the displaying of the media to a viewer. The projection system may also include a display device 220 to display the media. As explained in more detail below, the display device may take many forms, including one embodiment where the display device includes a projector 240 and a projection screen 245.

As stated, the projection system of the mobile set 200 may include a media control box 215. The media control box 215 may be in communication with a display device 220 to coordinate and provide the media that is to be displayed by the display device. For example, the media control box 215 may include a media storage 225 to store the media that is to be displayed by the display device 220. The media storage 225 may include any computer-readable medium, including but not limited to, an optical disks, flash media, floppy disks, hard drives, EEPROM memory and so on. One example of the media storage 225 may include a digital video disc (DVD). The DVD may be loaded into the media storage 225 of the media control box 215 to be read and sent to the display device at the appropriate time for display to a viewer. Alternatively, the media may be stored directly in the memory of the media storage 225 of the media control box 215. The media control box 215 may read the media from the media storage 225 and transmit the media to the display device 220 to be displayed to a viewer.

The media control box 215 may also be configured to receive the media from an independent transmitting device. In this configuration, the media control box 215 may receive the media from the transmitting device and send the media to the display device 220 for display. Alternatively, the display device 220 may receive the media directly from the transmitting device and may display the media to the viewer, thereby bypassing the media control box 215.

The media control box 215 may be further configured to respond to inputs provided to the media control box during the displaying of the media. For example, in one configuration, the mobile set 200 may be utilized as part of an amusement park ride to display media to the patrons of the ride. During the ride, the patrons may provide inputs to the mobile set 200 through a wireless device, perhaps in response to a question displayed to the patrons through the media. The patrons may then indicate a desire to continue viewing a particular scene in the media being displayed or change to another scene to view. The wireless device may then communicate with the media control box 215. The media control box 215 may receive the input provided by the patrons and select a particular media to present to the viewers. Upon selection of the media to present, the media control box 215 may send the media to the display device 220 to display the media to the patron. In a similar manner, the media control box 215 may receive an input provided by an amusement park ride administrator or operator to alter the media being displayed. Therefore, the media being presented to the viewers may be dynamic in its presentation.

In another embodiment, the media control box 215 may be in communication with the drive control box 205. The drive control box 205 may be configured to provide the media control box 215 with inputs that represent the position of the mobile set 200. In response to these inputs, the media control box 215 may select a particular media to display to the viewers. For example, the media control box 215 may be programmed to display no media during an initial phase of the mobile set 200. During the initial phase, the mobile set 200 may be positioned to interact with a viewer through the use of the drive mechanism 210 to properly place the mobile set in the correct position. During the movement of the mobile set 200, the drive control box 205 may provide inputs to the media control box 215 indicating the position of the mobile set. When the mobile set 200 reaches the correct position, the drive control box 205 may transmit a signal to the media control box 215 to begin displaying a certain media. Similarly, the drive control box 205 may provide inputs to the media control box 215 to select a different media presentation to provide to the viewers. In this manner, the drive control box 205 may provide positioning inputs to the media control box 215 to assist in selecting the particular media to provide to the viewers.

Also included in the embodiment of FIG. 2 may be a display device 220. The display device may be configured to receive an electronic image or media presentation from the media control box 215 and display the media to a viewer. In one embodiment, the display device may include a projector 240 and a projection screen 245. The projector 240 and projection screen 245 may be positioned such that the projector may project the electronic image or media onto the projector screen. One example of such positioning may place the projector 240 in front of the projection screen 245 such that the projector may project the media onto a projection screen. Another embodiment may include a rear-projection system, where the projector 240 is located behind the projection screen 245 and projects the media to the projection screen such that a viewer in front of the screen may view the displayed media. Other embodiments of the display device 220 may not include a projector 240 and projection screen 245 at all. For example, the display device may include a liquid crystal display (LCD) or plasma-type television screen to display the electronic image or media to a viewer. Further, the projector 240 may include a slide or film projector that may display the electronic image or media to the viewer. Generally, as used herein, the display device 220 of the mobile set 200 includes any display system that receives media from the media control box 215 and displays the media to a viewer.

The media provided by the media control 215 and displayed by the display device 220 may be any digital media. The media may include, but is not limited to: a filmed scene utilizing live actors, animals or locations; an animated scene utilizing drawn shapes; a real time image that may be controlled by an operator; and a real time mirrored image of the ride patrons. Generally, as used herein, "media" includes any digital media that may be displayed by the display device 220.

The embodiment of FIG. 2 may also include a power supply 250. The power supply 250 may power the modules of the mobile set 200, including the drive mechanism 210 and the display device 220. Several types of power supplies may be used for the mobile set 200. In one example, the mobile set 220 may follow a track or pre-determined path. The track may contain a bus bar that stays in constant contact with the mobile set 220 as the set moves along the track. The bus bar may be connected to a power supply on one end of the bus bar. The power flowing through the bus bar and into the mobile set 200 may provide power to the mobile set 220 to power the modules of the set. In another example, the power supply 250 may be carried along with the mobile set 200 as the set moves along its intended path. Further, the power supply 250 may be recharged to continue providing power to the mobile set 200. The recharging of the power supply may be done by a ride operator, or may be done at a docking station along the path of the mobile set 200 that allows the power supply 250 to be recharged at a specific position/time when the mobile set 200 is at rest.

Figure 3:
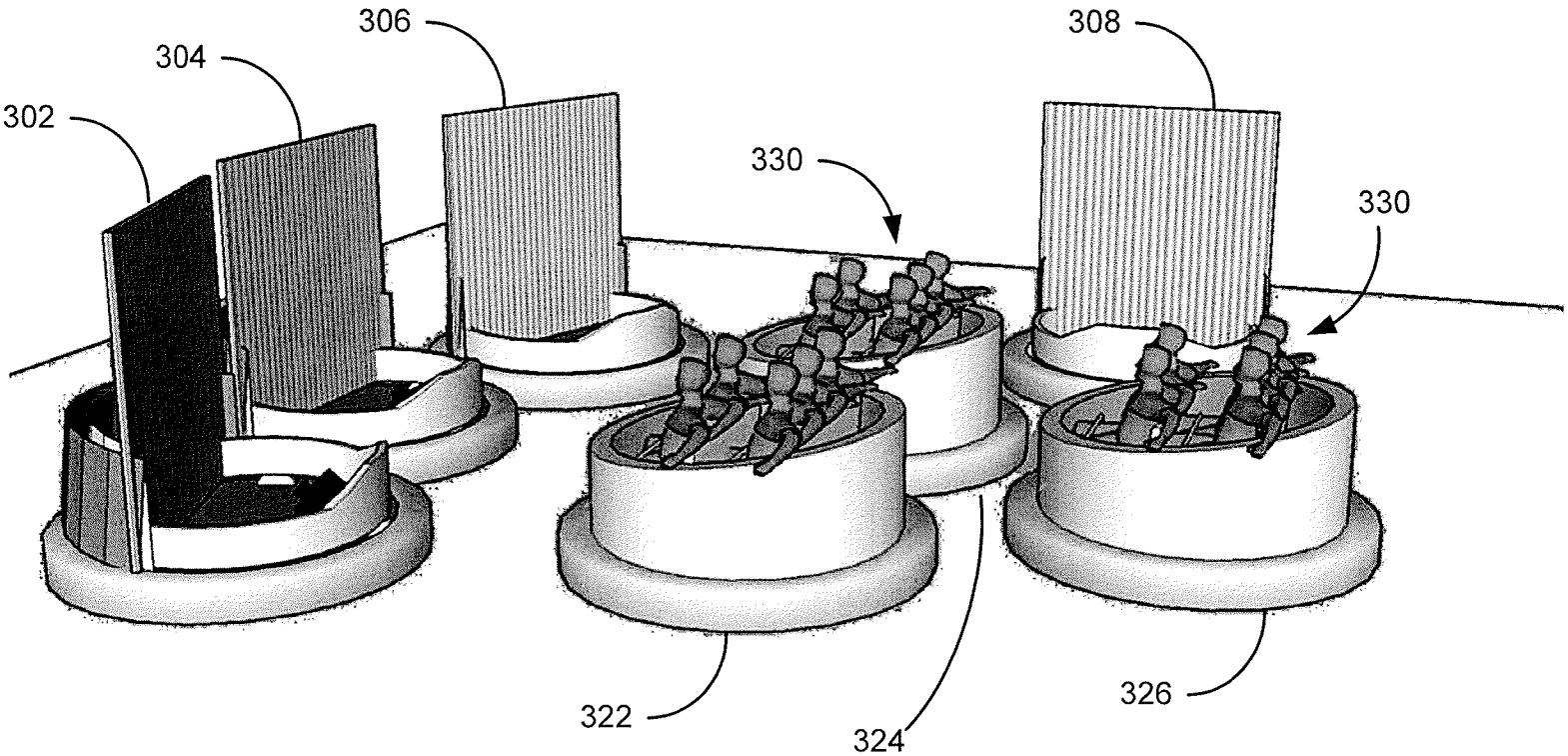
FIG. 3 depicts an embodiment of an amusement park ride with several mobile projected sets and several ride cars carrying several ride patrons.

FIG. 3 depicts an embodiment of an amusement park ride with several mobile projected sets and several ride cars each carrying several ride patrons. The amusement park ride may include one or more projected mobile sets and one or more patron vehicles to carry the ride patrons through the ride. Each mobile set and ride car may be capable of autonomous navigation or may follow a fixed path.

The amusement park ride depicted in FIG. 3 may include several mobile projected sets 302-308 each configured to provide a projected scene to the ride patrons. The mobile projected sets 302-308 may be similar to the mobile sets depicted in FIGS. 1 and 2. The ride may also include one or more ride cars 322-326 that may carry and transport the ride patrons 330 through the amusement park ride. The base of the ride cars 322-326 depicted in FIG. 3 are of a similar design to the base of the mobile projected sets 302-308. However, the ride cars 322-326 may be of any design that allows the cars to carry and transport the patrons of the ride through the amusement park ride.

As described above, a typical amusement park ride may place one or more ride patrons in a ride car 322-326 that follows a fixed route through the ride, or may follow a more autonomous navigation through the ride. Along the route, several displays or projected scenes may be provided to entertain the rider. In this embodiment, the mobile projected sets 302-308 may display one or more media presentations to the ride patrons 330 during the ride to entertain the patrons. As described in more detail below, the mobile projected sets 302-308 may also dynamically interact with the patrons 330 during the ride to provide a more enjoyable entertainment experience to the patrons of the ride.

Because each mobile projected set 302-308 has the capability of motion, the sets 302-308 may be positioned to directly interact with the ride patrons 330 being transported by the ride cars 322-326, whether the mobile set is autonomous or tracked. For example, one mobile projected set 304 may be positioned directly in front of a ride car 322. Further, the mobile set 304 may synchronize its movement to that of the rider car 322. This may provide a patron 330 traveling in the ride car 322 with a longer time to view the projected media on the projection screen of the mobile set 304. This movement of the mobile set and projected media may also provide a more entertaining experience for the patron 330 in the rider car 322.

One example of a mobile set 304 interacting and synchronized with a ride car 322 of an amusement park ride may include a scenario that places the patrons into a sporting event. In this experience, the ride patrons 330 may act as a football player running down the field while the projected media on the mobile set 304 may be that of an opponent football player. To simulate the sporting event, the opponent football player in the projected media may chase the ride car 322 at the same time that the mobile projected set 304 physically approaches the ride car 322. As the mobile set 304 approaches the ride car 322, the ride car may move to one side of the mobile projected set, simulating the patrons moving out of the way of the charging opponent football player. The mobile projected set 304 may also rotate to continue facing each other as the projected set 304 moves past the ride car 322. Further, the projected media on the projection screen of the mobile set 304 may switch display the opponent football player missing the patrons and sliding across the playing field. Thus, the mobility of the mobile set 304 combined with the media displayed to the patrons 330 may create an immersive visual experience for the patrons.

In a similar manner, several mobile projected sets 302-308 may also interact with several ride cars 322-326 to provide an even more dynamic experience for the patrons 330 of the ride cars. Expanding on the above example, several ride cars 322-326 may enter a large room within an amusement park ride containing several mobile projected sets 302-308. Each projection screen for the mobile sets 302-308 may depict an opponent football player in a sports stadium. Each ride car 322 may be positioned to provide the patrons with the feeling that they are also a football player. The mobile sets 302-308 may then begin interacting with the ride cars 322-326 as described above. The movement of the mobile sets 302-308 and the depicted scene of the opponent football players on the mobile sets may provide the patrons with the experience of running on a football field while being chased by the opponent team. Several mobile sets 302-308 may interact with the ride cars 322-326 to depict several football players attempting to tackle the patrons but missing them. Thus, when one mobile set 302-308 interacts with the ride cars 322-326 as described above, another mobile set may perform the same movements. In this manner, several mobile sets 302-308 may follow a fixed path to interact with several ride cars 322-326 carrying the ride patrons 330, providing the illusion that the projected opponent players on each mobile set 302-308 are attempting to tackle the patrons.

Similarly, several mobile sets 302-306 may be coordinated to display a single scene among the several mobile sets. For example, a scene of a cheetah may be displayed by the mobile sets 302-306. Mobile set 302 may display a scene of a savannah on the projection screen. Mobile set 304 may display a similar scene of a savannah on its projection screen. Mobile set 306 may display a scene of a savannah with a cheetah on the projection screen. The cheetah displayed on mobile set 306 may begin to run towards mobile set 304. As the cheetah exits the displayed scene of mobile set 306, the running cheetah may appear on the displayed scene of mobile set 304. The cheetah may continue through the displayed scene of the mobile set 304 onto the displayed scene of mobile set 302. In this manner, the displayed screens of several mobiles sets 302-306 may be coordinated to display a single scene to a viewer.

The coordination between the several mobile sets 302-306 to display a single scene among several projection screens may occur in several ways. For example, each mobile set 302-306 may store a media presentation that is coordinated with other media presentations to provide the illusion that the mobile sets are coordinated to display the scene on several screens. In another example, the mobile sets 302-306 may be positioned such that one projector located on a middle mobile set may project a single image onto all of the mobile projection screens. In a third example, the mobile sets 302-306 may communicate with each other through a receiving device on each mobile set. The communication between the mobile sets 302-306 may allow the mobile sets to provide the presented media to a user such that a single scene may be displayed on multiple projection screens. These are just a few examples of the many ways that the mobile sets 302-306 may be coordinated to display a single scene to a viewer.

Described above are just some examples of the many varied ways that one or more mobile projected sets 302-308 may interact with ride patrons 330 in an amusement park ride. The interaction between the mobile set 302-308, the projected scene and the ride patron 330 is only limited by the imagination of the amusement park ride designer. Further, the mobile projected sets may not be limited to amusement park rides. The sets may provide a projected scene on a vehicle in several different environments. For example, a series of projection devices may be included on a group of boats. Each projection boat may present a projected scene to viewers located on the shore of a body of water or on other boats near the projection boats. A series of projection boats may be used to create a water pageant with each projection boat displaying an entertaining scene to the viewers of the pageant. In another example, the mobile sets may roam around the amusement park displaying entertaining or informative media on the projection screens. The mobile sets may also be used as part of a stage or theatre show to entertain the audience and interact with the actors. Thus, the mobile projected sets described above may be utilized in several environments to provide the projected media to one or more viewers.

FIGS. 4*a*-4*e* depict an overhead view of an amusement park ride that may include several mobile projected sets to interact with the ride patrons and provide a more dynamic and enjoyable experience for the patrons. Specifically, FIGS. 4*a*-4*e* depict a sequence demonstrating one embodiment of an amusement park ride that utilizes the mobile projected sets to reconfigure and alter the sightlines of the patrons, as well as to provide a projected media to the ride patrons. The movement of the mobile projected sets depicted in the series of figures is only one possible configuration of an amusement park ride. As described above, several different configurations of mobile sets and ride cars may be constructed to provide the ride patrons with an enjoyable and entertaining experience.

Figure 4A:
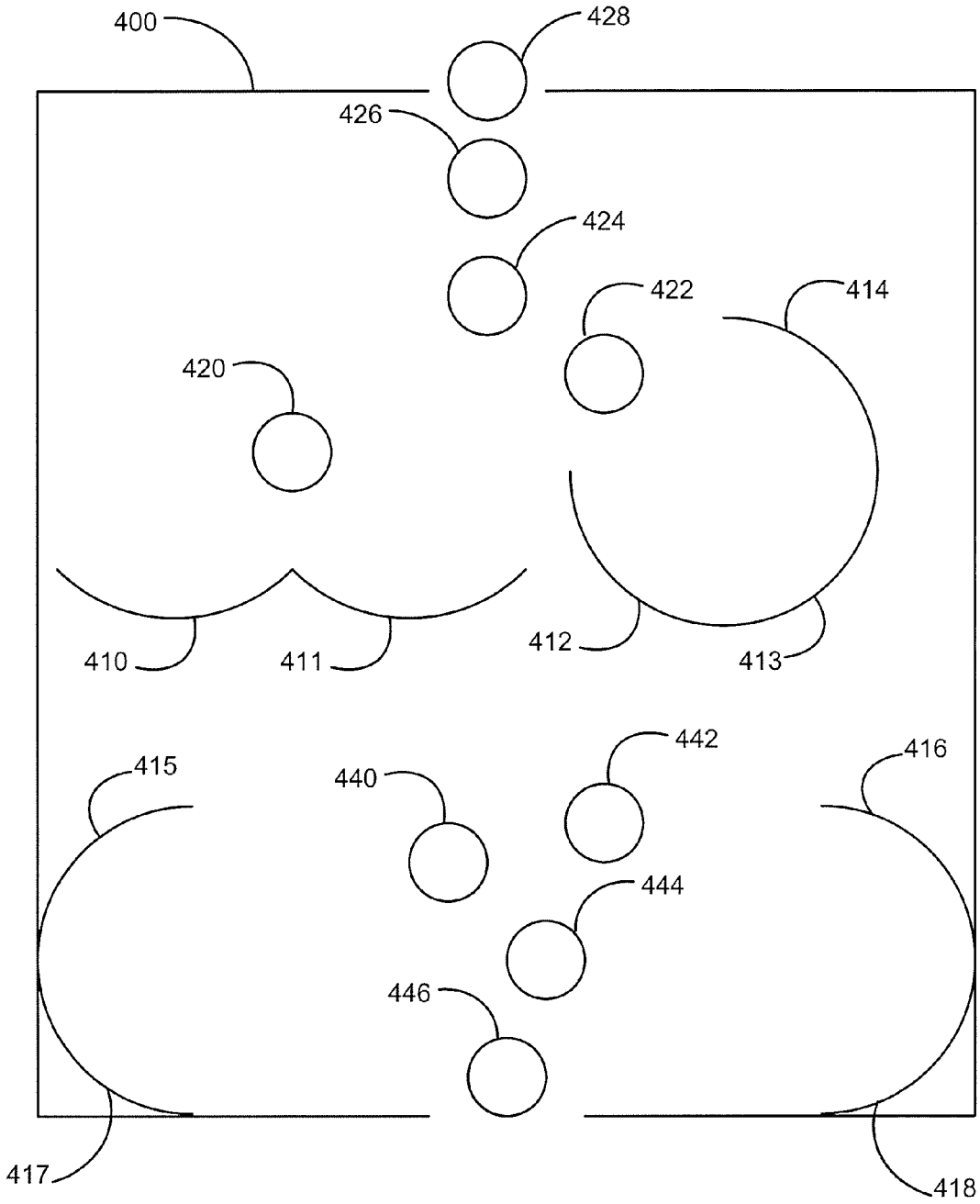
FIG. 4*a* is a representative top view of a plurality of mobile projected sets and other aspects of the present disclosure in a first relative configuration.

FIG. 4*a* depicts a room 400 included as part of an amusement park ride. The ride may include several mobile projected sets 410-418 depicted as arcs in FIGS. 4*a*-4*e*. Each mobile projected set 410-418 may be configured to provide a projected scene to the ride patrons, as well as alter the sightlines of the patrons of the ride and the shape and size of the room 400. The mobile projected sets 410-418 of FIGS. 4*a*-4*e* may be similar to the mobile sets depicted in FIGS. 1, 2 and 3 described above. The ride may also include one or more ride cars 420-428 (depicted as circles in the figures) that may carry and transport the ride patrons through the amusement park ride.

As depicted in FIG. 4*a*, several ride cars 420-428 carrying one or more patrons may enter the room 400 containing several mobile projected sets 410-418 through a door at the top of the figure. At the same time, several other ride cars 440-446 may be exiting the room 400 at a door located at the bottom of the figure. The exiting ride cars 440-446 may have just viewed the media presentation provided by the mobile projected sets 410-418 and may be exiting to another room of the ride or may be exiting the ride altogether.

As the ride cars 420-428 are entering the room 400, several mobile projected sets 410-418 may be positioned to block the exiting cars 440-446 from view of the patrons in the entering cars. For example, the patrons located in ride car 420 may not be able to view the exiting ride cars 440-446 because several mobile projected sets 410-411 may block the sightline of the patrons. The mobile sets 410-418 located within the room 400 may be positioned through the use of a drive mechanism as described above. By placing the mobile projected sets 410-418 in the sightline of the patrons of the entering cars 420-428, the mobile sets may maintain the illusion that the patrons in the entering ride cars may be the only patrons on the ride at any time. Further, by engaging the patrons immediately upon entering the room 400, the amusement park ride may maintain the attention of the ride patrons without the patrons becoming distracted by the exiting cars 240-246. This may add to the enjoyment of the ride to the patrons.

Further, several mobile sets 415-418 may be placed around the room 400 to alter and create the dimensions and shape of the room. These sets 415-418 may also change their positions during the time that the patrons are in the room 400 to create a feeling of the room dimensions shifting. For example, in one example of an amusement park ride, the mobile sets may move towards the ride cars, creating the illusion that the room 400 is getting smaller. By changing the dimensions of the room, the mobile projected sets may further add to the enjoyment of the ride experienced by the patrons.

Figure 4B:
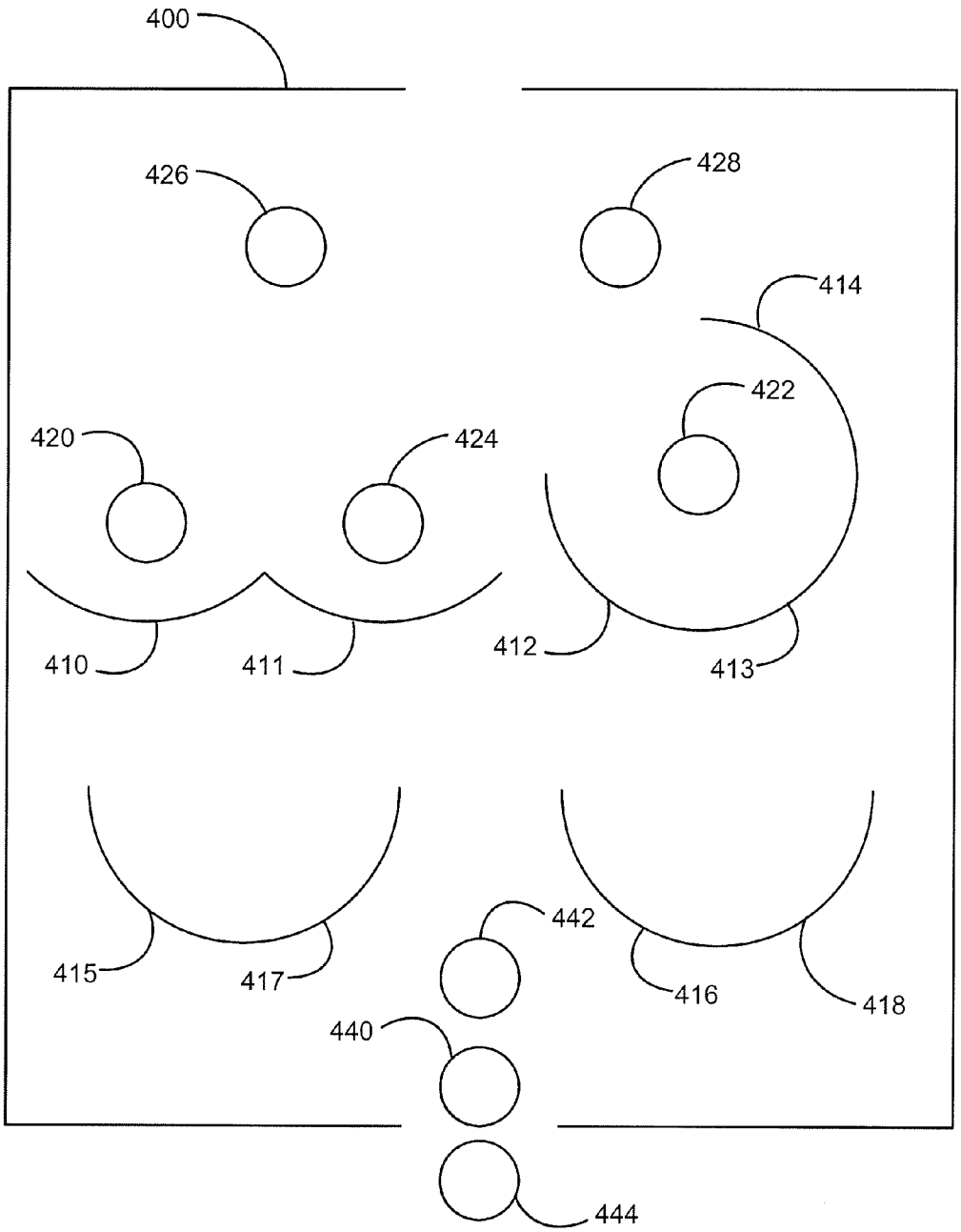
FIG. 4*b* is a representative top view of a plurality of mobile projected sets and other aspects of the present disclosure in a second relative configuration to that illustrated in FIG. 4*a*.

FIG. 4*b* depicts the amusement park room 400 as the entering ride cars 420-428 are maneuvered into a position to engage and interact with several mobile projected sets 410-414. As shown, several mobile projected sets 410-414 may engage ride cars 420-424 while other ride cars 426-428 may be positioned behind the engaged ride cars. As mentioned above with reference to FIGS. 1-3, the mobile projected sets 410-414 that are in view of the patrons in the entering ride cars 422-428 may display a media presentation as the cars enter the room 400. The media presentation displayed to the patrons by the mobile projected sets may be displayed in a similar manner as described above with reference to FIGS. 1-3. Alternatively, the mobile projected sets 410-414 may wait until the entering ride cars 420-428 are in a starting position before beginning the media presentation.

As also depicted in FIG. 4*b*, several mobile projected sets 415-418 that may not be directly in view of the patrons of the entering ride cars 420-428 may be maneuvered into a position to engage and interact with the ride cars as the ride cars progress through the room 400. Further, the last few exiting ride cars 440-444 may be leaving the room 400 at the same time that the entering ride cars 420-428 are moving into the starting position.

Figure 4C:
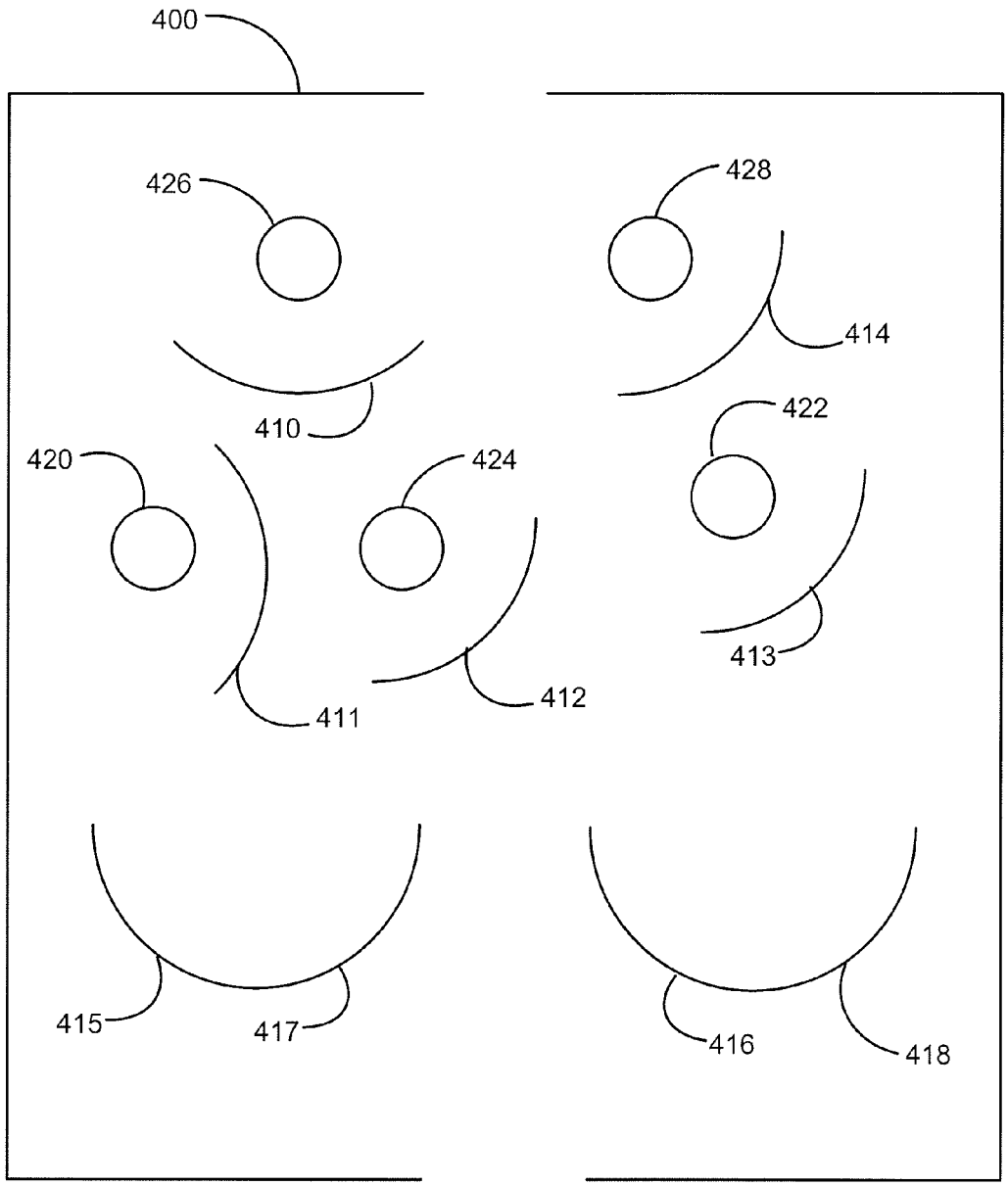
FIG. 4*c* is a representative top view of a plurality of mobile projected sets and other aspects of the present disclosure in a third relative configuration to that illustrated in FIGS. 4*a* and 4*b*.

FIG. 4*c* depicts several mobile projected sets 410-414 interacting with several ride cars 420-428 to display a presentation media to the patrons of the ride cars. In addition to the media presentation, the interaction may also coordinate and synchronize the movement of the mobile projected sets 410-414 to further interact with the patrons. For example, as described above, the mobile sets 410-414 may present a opponent football player on the projection device of the mobile sets. Each mobile set 410-414 may first engage a ride car 420-428 by maneuvering in front of the ride car and presenting the football player on the projection screen. The mobile sets 410-414 may then simulate the player of the mobile set attempting to tackle the patrons of the ride cars 420-428. Further, a single mobile set may interact with several ride cars 420-428 during the amusement park ride. While FIG. 4*c* depicts a sporting event interaction as described above, the presentation displayed to the patrons by the mobile sets 420-428 may be any presentation imagined by the ride designer.

Figure 4D:
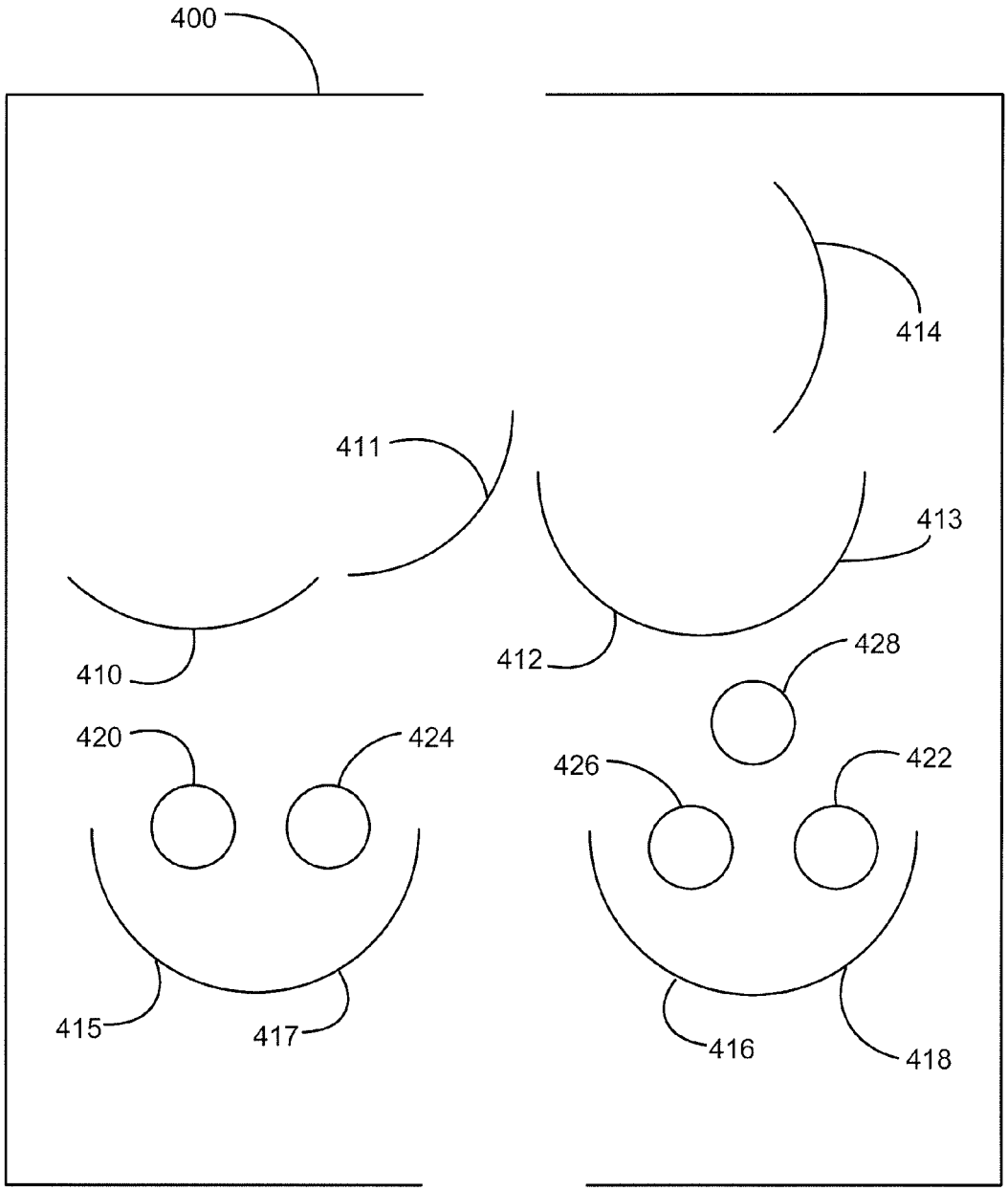
FIG. 4*d* is a representative top view of a plurality of mobile projected sets and other aspects of the present disclosure in a fourth relative configuration to that illustrated in FIGS. 4*a*-4*c*.

In FIG. 4*d*, as the ride progresses, the ride cars 420-428 may move away from the first set of mobile projected sets 410-414 and engage a second set of mobile sets 415-418. The second set of mobile sets 415-418 may provide a second media presentation to the patrons of the ride cars 420-428 in a similar manner as the first set of mobile projected sets 410-414. The second set of mobile sets 415-418 may also synchronize its movements with the ride cars 420-428 as described above. Thus, the second set of mobile projected sets 410-414 may provide further entertainment to the ride patrons as the ride cars 420-428 move through the room 400.

During the time that the ride cars 420-428 are interacting with the second set of mobile projectors 415-418, the first set of mobile projectors 410-414 may be repositioning to block the view of the next set of ride cars that may enter the room 400. Thus, when a new set of ride cars enters the room, the sightline to the exiting ride cars 420-428 may be blocked by the first set of mobile projector sets 410-414.

Figure 4E:
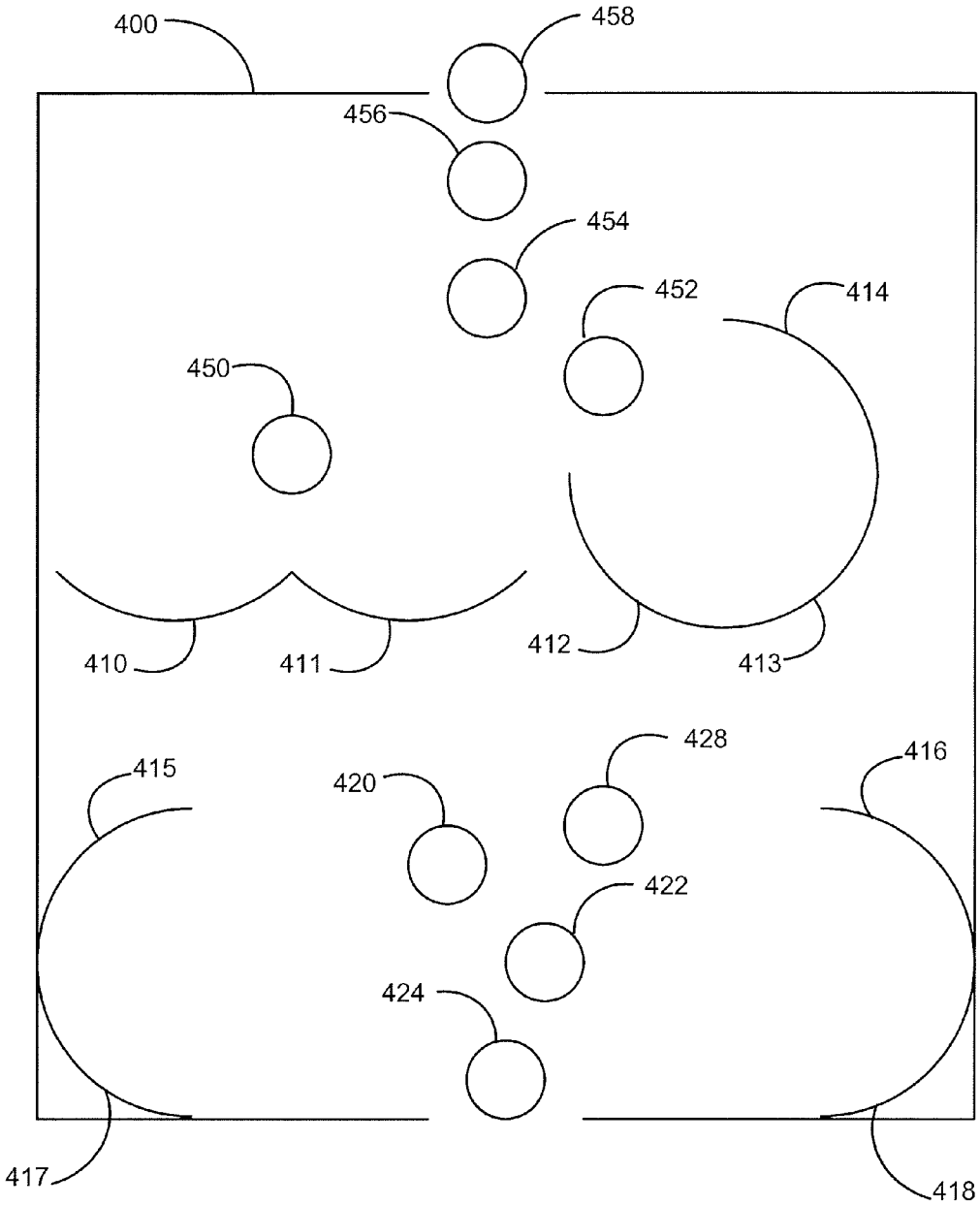
FIG. 4*e* is a representative top view of a plurality of mobile projected sets and other aspects of the present disclosure in a fifth relative configuration to that illustrated in FIGS. 4*a*-4*d*.

In FIG. 4*e*, a new set of ride cars 450-458 may enter the room 400 through the door located at the top of the figure as the set of ride cars 420-428 begin exiting the room through the door located at the bottom of the figure. Also, the second set of mobile projector sets 415-418 may move back into a starting position to prepare for the next set of ride cars 450-458 that may move through the ride. Thus, the mobile sets of room 400 are in position to accept another round of ride cars carrying patrons. The above operations may be repeated to provide an entertainment experience to several patrons.

The amusement park ride may coordinate the movement of the ride cars 420-428 and the mobile projector sets 410-418 in several ways. For example, a series of sensors may be placed within the ride room 400 to detect the position of each ride car as the cars move through the room. A central controlling computer may receive the signals provided by the sensors to coordinate the movements of the mobile projector sets 410-418. The central controlling computer may trigger the mobile sets 410-418 to begin their movements once the computer receives the correct signal from the series of sensors. Alternatively, the sensors may provide an input directly to the mobile sets 410-418 such that the mobile sets may begin their movements once the input from the sensor is received. The sensors may detect movement of the ride cars or may detect a specific object to begin the mobile set movement. In another example, the mobile sets 410-418 may be coordinated to the ride cars through a timed response. Once a ride car enters the room 400, each mobile set 410-418 may begin movement after a specific amount of time has passed, i.e. a mobile set 410 may begin moving 10 seconds after a ride car 420 enters the room. In a third example, a central controlling computer may detect the position of each ride car 420-428 and mobile set 410-418 of the ride. The central controlling computer may coordinate the movements of each vehicle of the ride in response to inputs or by providing a pre-determined path to the vehicles. Alternatively, the mobile sets 410-418 may receive a human input to determine the movement of the mobile sets, such as instructions from a patron or ride operator. The above examples are just a few of the many ways that the mobile sets 410-418 may be coordinated to interact with the ride cars 420-428 of an amusement park ride.

Figure 5:
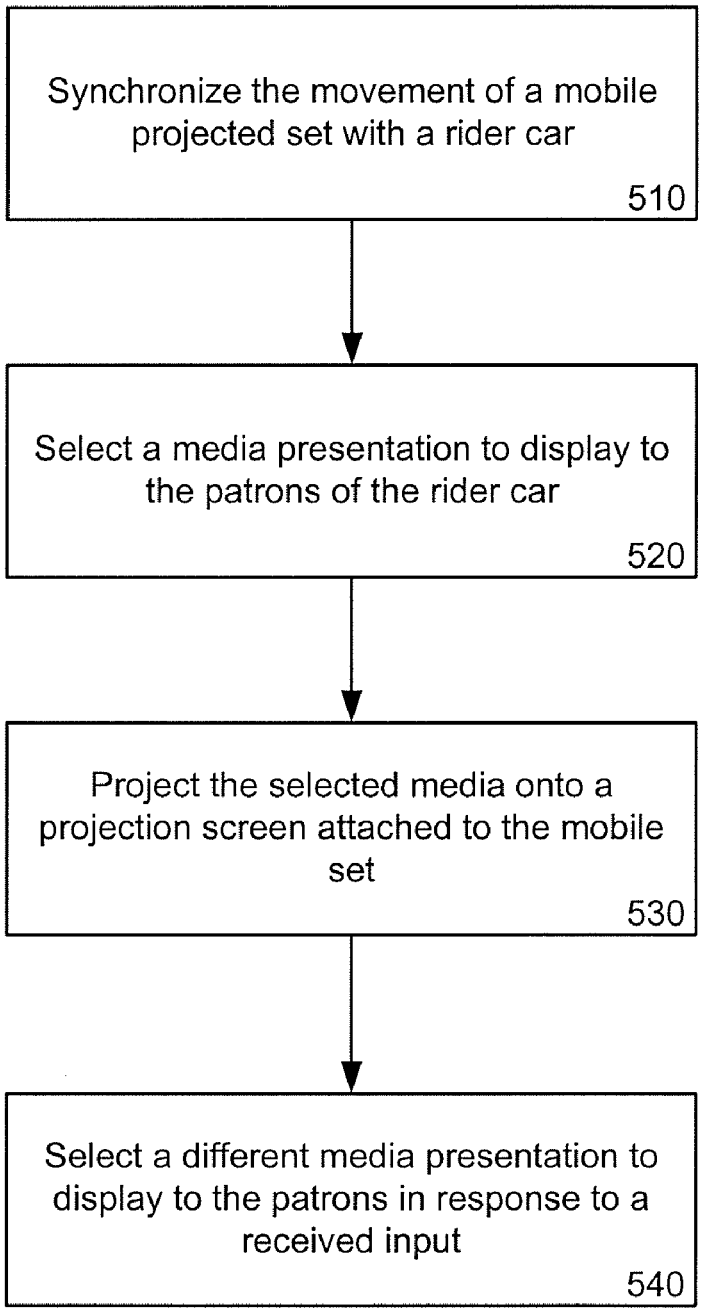
FIG. 5 is a flowchart for the use of a mobile projected set in an amusement park ride.

FIG. 5 is a flowchart for the use of a mobile projected set in an amusement park ride. Similar to the scenarios described above with reference to FIG. 3, the method described herein to for use of a mobile projected set in an amusement park ride may provide the patrons of the ride with a longer view time of each display as well as provide a more dynamic entertainment experience to the patrons of the ride.

The embodiment may being in operation 510 by coordinating the movement of the mobile set with that of a ride car of the amusement park ride. Similar to the coordination described above, the mobile set may interact and mirror the movements of a ride car to provide the patrons riding within the ride car a longer time to view the mobile sets. In other embodiments, the mobile set may coordinate with the ride car by following a fixed path to interact with the patrons of the ride car. For example, the mobile set may follow a fixed path of circling the ride car that may simulate the mobile set dancing with the ride car. Generally, any movement of the mobile set while interacting with the patrons of the ride car may be considered coordinating the movement of the mobile set with that of a ride car.

In operation 520, a media presentation may be selected to display to the patrons of the ride. Similar to the descriptions above, the media may be selected in response to a position of the mobile set or may be selected by an input provided to the mobile set by an outside source. The media may be selected to provide an entertaining experience for the patrons of the amusement park ride. Further, the media may generally be part of an overall design for the amusement park ride, possibly providing chapters or scenes for a continuous story being told by the ride.

In another embodiment, the media presented to the patrons of the ride may be selected by the patrons themselves. For example, the ride car of the amusement park ride may be configured to carry a single patron. Each ride car may have a mobile projected set to interact with the ride car carrying the patron. The patron may use a remote control or similar wireless device to select which media is presented to the patron by the mobile projected set. Alternatively, the media presented may be pre-selected by a ride operator or designer.

In operation 530, the media selected in operation 520 may be projected onto a projection screen that is attached to the mobile set. The projected media may be presented in such a way that the patrons of the amusement park ride may view the media. For example, the media may be projected onto a screen attached to the mobile set as the mobile set is moved within eyesight of the patrons. The media may engage and entertain the patrons within a ride car as the ride car moves through the ride. As described above, the projection system attached to the mobile set may include a projector and projection screen or may include a television device, such as an LCD or plasma television.

In operation 540, the media being presented to the patrons of the ride may be altered in response to an input received by the mobile set. For example, as described above, the patrons of the ride may provide an input to the mobile set to change the media being presented. The input may be provided through a wireless device that is attached to the ride car of the patrons. Alternatively, the input received by the mobile set may come from a ride operator or a computer configured to control the movement of the sets within the ride. Generally, an input may be provided from any source that may cause the mobile set to select a different media to be presented to the patrons.

In one embodiment, the media being presented to the patrons of the ride may be altered in response to the position of the mobile set. As explained above, a drive controller may an input to the mobile projected set indicating the position of the mobile set. In response to those inputs, the mobile projected set may select which media is presented to the patron. For example, as the mobile set first engages a ride car carrying one or more patrons, a first media presentation may be displayed on the mobile set's display device. The mobile set and the ride car may then begin to move together or in an otherwise coordinated fashion. During the movement of the mobile set, position inputs may be continually provided to the mobile set by a drive controller. After a certain time, the mobile set may reach a position that the mobile set associates with an alteration to the media being presented. Thus, in response to the position of the mobile set, the set may select a second media presentation to display to the patron, in place of the first media presentation. Therefore, the media being presented to the patrons of the ride may be altered in response to a position input provided to the mobile set. Alternatively, the position inputs may come from a series of sensors located on the mobile set and emitters located at each mobile set position indicating the position of the mobile set. Further, the position inputs may be sent to the mobile set from a controller computer that sends the position input to the mobile set wirelessly.

It should be noted that the flowchart of FIG. 5 is illustrative only. Alternate embodiments may add operations, omit operations, or change the order of operations without affecting the spirit and scope of the present disclosure.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. From the above description and drawings, it will be understood by those of ordinary skill in the art that the particular embodiments shown and described are for purposes of illustrations only and are not intended to limit the scope of the present invention. References to details of particular embodiments are not intended to limit the scope of the invention.

What is claimed is:

1. A mobile electronic image display system comprising:

an automated mobile set; and a display device supported on the automated mobile platform, the display device in communication with a display media control configured to provide one or more electronic images for presentation on the display device;

at least one guest ride vehicle in synchronous movement with the automated mobile set, wherein the display device is configured to move on a separate travel path from the at least one guest ride.

2. The mobile electronic image display system of claim 1 further comprising:

a track path, wherein the automated mobile set is configured to follow the track path to provide the synchronous movement with the at least one guest ride vehicle.

3. The mobile electronic image display system of claim 1 wherein the automated mobile set further comprises a motor operably coupled with a drive controller, the drive controller in communication with at least one memory element having executable instructions for propelling the platform through a preprogrammed path.

4. The mobile electronic image display system of claim 3 further comprising:

a wireless network in communication with the drive controller;

the drive controller including:

a drive instruction receiving device configured to receive executable instructions over the wireless network, the executable instructions configured to be interpreted by the drive controller to guide the automated mobile set.

5. The mobile electronic image display system of claim 1 wherein the automated mobile set is a mobile automated guided vehicle.

6. The mobile electronic image display system of claim 1, wherein the display media control is in communication with the drive controller and selects the one or more electronic images in response to at least one of a position and a timed event input provided by the drive controller.

7. The mobile electronic image display system of claim 1 wherein the one or more electronic images are at least one of a video image and a film.

8. The mobile electronic image display system of claim 1, wherein the display device comprises:

a projector in communication with the display media control, the projector configured to receive the one or more electronic images from the display media control; and a projection screen positioned to receive and display the one or more electronic images.

9. The mobile electronic image display system of claim 1, wherein the display device is at least one of a television, a liquid crystal display, a plasma display, and a projector and projection screen.

10. The mobile electronic image display system of claim 1, wherein the display media control further comprises:

a media receiving device configured to receive the one or more electronic images over a wireless communications network.

11. The mobile electronic image display system of claim 10, wherein the display media control selects the one or more electronic images to be displayed by the display device in response to an input received by the media receiving device.

12. The mobile electronic image display system of claim 1, wherein the display media control further comprises:

a media storage configured to store the one or more electronic images.

13. A method of providing mobile electronic images comprising:

coordinating the movement of a mobile display set with a separate rider vehicle, the rider vehicle configured to transport at least one patron and to move on a separate travel path from the mobile display set;

selecting the electronic images to display on the mobile display set; and displaying the electronic images on a display device of the mobile display set, the mobile display set configured such that the electronic images may be viewed by the at least one patron.

14. The method of claim 13, further comprising:

receiving an input through a wireless connection; and altering the electronic images in response to the input provided by at least one patron.

15. The method of claim 13, wherein the selecting operation comprises:

storing a plurality of electronic images on a computer-readable storage device;

receiving an input and selecting one of the plurality of electronic images, the received input being a function of at least one of the position of the mobile display set and time.

16. The method of claim 13, wherein the displaying operation comprises:

providing the selected electronic image to a projector; and projecting the electronic image onto a projection screen, wherein the projection screen is positioned such that the at least one patron can view the media presentation.

17. The method of claim 13, wherein the coordinating operation comprises:

receiving a data message through a wireless connection, the data message indicating the direction and speed of the mobile display set; and providing the data message to a drive mechanism, the drive mechanism configured to move the mobile display set in response to the data message;

wherein the received data message is configured to provide an interaction between the mobile display set and the at least one patron.

18. The method of claim 17 wherein the received input is provided by at least one of a ride operator and a computing device.

19. The method of claim 13, wherein the coordinating operation comprises:

providing an input signal to a drive mechanism, the drive mechanism configured to move the mobile display set along a track, wherein the track path is configured to provide an interaction between the mobile display set and the at least one patron.

20. The method of claim 13, wherein the displaying operation comprises:

synchronizing the display of the electronic images across a plurality of mobile display sets.

21. A method of providing mobile electronic images comprising:

coordinating the movement of a mobile display set with a separate rider vehicle, the rider vehicle configured to transport at least one patron, wherein the coordinating operation comprises:

moving the mobile display set along a first pre-determined path; and moving the separate ride car vehicle along a second pre-determined path;

wherein the first pre-determined path and the second pre-determined path provide synchronized movement of the mobile display and the separate ride car vehicle such that the mobile display is visible to the at least one patron along a portion of the paths;

selecting the electronic images to display on the mobile display set; and displaying the electronic images on a display device of the mobile display set, the mobile display set configured such that the electronic images may be viewed by the at least one patron.

* * * * *